US006688268B2

(12) United States Patent
Schlembach et al.

(10) Patent No.: US 6,688,268 B2
(45) Date of Patent: Feb. 10, 2004

(54) CONNECTION BETWEEN A SHAFT END OF A GAS EXCHANGE VALVE OF AN INTERNAL COMBUSTION ENGINE AND A FINAL CONTROL ELEMENT OF A VALVE ACTUATOR

(75) Inventors: Hans Schlembach, Muehlacker (DE); Hermann Gaessler, Vaihingen (DE); Udo Diehl, Stuttgart (DE); Karsten Mischker, Leonberg (DE); Rainer Walter, Pleidelsheim (DE); Ulf Pischke, Stuttgart (DE); Andreas Baumann, Markgroeningen (DE); Hubert Schweiggart, Stuttgart (DE); Gerhard Filp, Freiberg (DE); Bernd Rosenau, Tamm (DE); Juergen Ulm, Eberdingen (DE); Uwe Hammer, Markgroeningen (DE); Thomas Mocken, Sersheim (DE); Sevan Tatiyosyan, Sersheim (DE); Juergen Schiemann, Markgroeningen (DE); Christian Grosse, Kornwestheim (DE); Volker Beuche, Stuttgart (DE); Stefan Reimer, Markgroeningen (DE); Simon Kieser, Sachsenheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/110,709

(22) PCT Filed: Jul. 20, 2001

(86) PCT No.: PCT/DE01/02762

§ 371 (c)(1),
(2), (4) Date: Jul. 23, 2002

(87) PCT Pub. No.: WO02/14655

PCT Pub. Date: Feb. 21, 2002

(65) Prior Publication Data

US 2003/0019453 A1 Jan. 30, 2003

(30) Foreign Application Priority Data

Aug. 17, 2000 (DE) ..... 100 40 114

(51) Int. Cl.[7] ..... F01L 1/14

(52) U.S. Cl. ..... 123/90.48; 123/90.12; 123/90.52

(58) Field of Search ..... 123/90.12, 90.13, 123/90.48, 90.52, 188.2, 188.3, 190.1, 190.12, 190.7

(56) References Cited

U.S. PATENT DOCUMENTS 5,485,815 A * 1/1996 Shida ..... 123/188.3

OTHER PUBLICATIONS

Gaessler et al. Connection Between Two Shaft Ends, Positioned Coaxially One Behind The Other, Of A Gas shuttle Valve In An Internal Combustion Engine And A Valve Actuator, US Patent Publication Pub. No. US 2003/0029410, Feb. 13, 2003.*

* cited by examiner

*Primary Examiner*—Thomas Denion
*Assistant Examiner*—Ching Chang
(74) *Attorney, Agent, or Firm*—Ronald E. Greigg

(57) ABSTRACT

A connection between a shaft end of a gas exchange valve of an internal combustion engine and a final control element of a valve actuator, with at least two shell-shaped wedge-shaped pieces, surrounding the shaft end and braced on the final control element, whose radially outer circumferential surface extends conically and which are surrounded by at least one conical clamping sleeve whose radially inner circumferential surface extends complimentary to the cone angle of the wedge-shaped pieces, wherein on the radially inner circumferential surface of the wedge-shaped pieces and on the radially outer circumferential surface of the shaft end of the gas exchange valve, protrusions and recesses that mesh with one another are provided. To enable rotary motions of the shaft end relative to the wedge-shaped pieces, the latter adjoin one another without gaps in the circumferential direction, forming an encompassing wedge-shaped sleeve, whose inside diameter is slightly larger than the outside diameter of the shaft end of the gas exchange valve, and that the protrusions and recesses mesh with one another with slight play.

20 Claims, 2 Drawing Sheets

CONNECTION BETWEEN A SHAFT END OF A GAS EXCHANGE VALVE OF AN INTERNAL COMBUSTION ENGINE AND A FINAL CONTROL ELEMENT OF A VALVE ACTUATOR

CROSS-REFERENCE TO RELATED APPLICATIONS

This application is a 35 U.S.C. 371 application of PCT/DE 01/02762, filed on Jul. 20, 2001.

BACKGROUND OF THE INVENTION

1. Field of the Invention

The invention is based on a connection between a shaft end of a gas exchange valve of an internal combustion engine and a final control element of a valve actuator.

2. Description of the Prior Art

A connection of the type with which this invention is concerned is known from International Patent Disclosure WO 99/66177, with at least two shell-shaped wedge-shaped pieces, surrounding the shaft end and braced on the final control element, whose radially outer circumferential surface extends conically and which are surrounded by at least one conical clamping sleeve whose radially inner circumferential surface extends complimentary to the cone angle of the wedge-shaped pieces, and which is braced on the shaft end axially by a nut screwed onto this end. On the radially inner circumferential surface of the wedge-shaped pieces there is an annular protrusion, which engages an annular groove on the radially outer circumferential surface of the shaft end. The final control element is formed by a differential piston, which can slide up and down inside a cylinder housing of the valve actuator depending on the pressure impingement on its piston end faces pointing away from one another.

Because of the wedging action and the axially prestressed conical clamping sleeve, one radially inner circumferential surface of each of the wedge-shaped pieces rests flush with the shaft end of the gas exchange valve, creating a static frictional engagement between the shaft end and the wedge-shaped pieces that are braced on the differential piston. Rotation of the gas exchange valve about its longitudinal axis, which is favorable for instance for the sake of uniform wear of the valve seat, is then possible only together with a differential piston. Since the pressure chambers, defined by the differential piston and subjected to hydraulic fluid that is under pressure, are sealed off from one another and from the environment by high-pressure seals, relatively high frictional forces must be overcome if the differential piston is to rotate.

SUMMARY OF THE INVENTION

The connection according to the invention between a shaft end of a gas exchange valve of an internal combustion engine and a final control element of a valve actuator has the advantage over the prior art that it is effected not by frictional engagement but by positive engagement by means of the protrusions and recesses that engage one another with play, and thus allows rotary motions of the shaft end relative to the final control element. The slightly larger diameter, compared to the shaft end, of the wedge-shaped sleeve formed by the wedge-shaped pieces prevents a frictional engagement, in a manner fixed against relative rotation, between the final control element and the gas exchange valve. Then the final control element need not be rotated along with the gas exchange valve in order to achieve the advantages, such as making valve wear uniform in terms of the circumferential direction or to keep the valve seat free of deposits, advantages known to be associated with regular rotation of the gas exchange valve about its longitudinal axis. Furthermore, the shooting flame of the combustion process then does not always strike the same point of the valve plate, which effectively prevents the development of burned holes. Since the final control element does not rotate along with the gas exchange valve, it can moreover be rotated more easily because the frictional forces are less.

In an especially preferred embodiment, the difference in diameter between the inside diameter of the wedge-shaped sleeve and the outside diameter of the shaft end of the gas exchange valve preferably amounts to a few hundredths of a millimeter. To make it possible to transmit the tensile and compressive forces, the wedge-shaped pieces have at least one annular bead, extending in the circumferential direction and formed on their radially inner, cylindrical circumferential surface, of which annular beads each one engages an associated annular groove embodied in the shaft end, exerted by the final control element on the gas exchange valve, essentially by positive engagement. The annular beads and annular grooves have an essentially semicircular cross section. To avoid a frictionally engaged clamping action between the annular beads and the annular grooves, the inside radius of the annular grooves is slightly greater than the outside radius of the annular beads.

A further refinement provides that a shaft of the gas exchange valve extends from a cylinder head of the engine through an actuator housing of the valve actuator until essentially inside a region of an opening, embodied in an upper wall of the actuator housing. As a result, the valve actuator can be mounted as a completely pre-assembled unit on the cylinder head first, and then the connection of the gas exchange valve and the final control element can be made through the opening or outside the valve actuator housing, which makes it substantially easier to install because of the free accessibility of the opening from above.

Preferably, the final control element of the valve actuator is formed by an actuator sleeve, which with radial spacing surrounds the shaft end of the gas exchange valve and whose free end protrudes some distance out of the opening in the wall of the actuator housing. A radially outer circumferential surface of the conical clamping sleeve is flush with a radially inner, cylindrical circumferential surface of the actuator sleeve, whose inside diameter in the region of the free end of the actuator sleeve is reduced in stages toward the cylinder head by means of a step. Viewed in the radial direction, the conical clamping sleeve is then disposed between the wedge-shaped pieces and the radially inner circumferential surface of the free end of the actuator sleeve, and toward this free end, the outer diameter of the wedge-shaped pieces is conically tapered and the inner diameter of the conical clamping sleeve is conically widened. For bracing the conical clamping sleeve on the actuator sleeve, a clamping body that clamps the conical clamping sleeve to the wedge-shaped pieces is provided, which is braced on the free end of the actuator sleeve by means of a thread or by means of a securing ring that engages a radially inner annular groove of the actuator sleeve, as a result of which the wedge-shaped pieces are axially braced against the step.

Threads or annular grooves for securing rings form notches, however, which can lessen the durability of the connection, which in gas exchange valves is subject to a high number of load changes. Because in a further preferred provision the thread or the securing ring is disposed in a region of the actuator sleeve which is spaced apart preferably axially from the wedge-shaped pieces and conical clamping sleeves that are wedged into one another, the thread or the annular groove for the securing ring is located outside the flow of force and is thus not exposed to any alternating force-introduction stresses. Instead, the thread or the annular groove for the securing ring is subject only to the essentially static prestressing forces that via the wedging action assure that the wedge-shaped pieces hold together. The introduction of force into the gas exchange valve is accordingly accomplished not through the thread or the securing ring but rather through the positive connection made as a result of the intermeshing protrusions and recesses.

In a preferred way, a clamping shim is disposed between the clamping body and an end face, toward the clamping body, of the conical clamping sleeve. As a result, settling of the components that may occur can be compensated for, and the requisite axial prestressing in the connection can be maintained.

BRIEF DESCRIPTION OF THE DRAWINGS

One exemplary embodiment of the invention is described in further detail herein below, with reference to the drawings, in which.

DESCRIPTION OF THE PREFERRED EMBODIMENT

Figure 1:
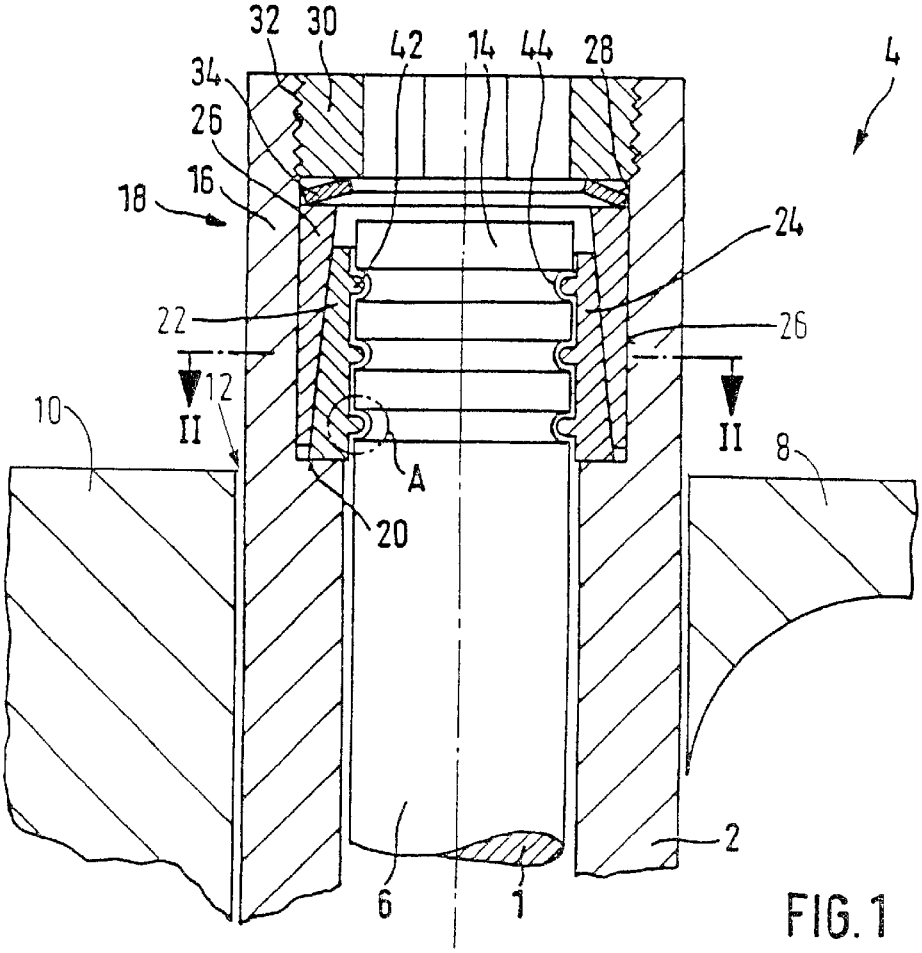
FIG. 1, a lateral cross-sectional view of a preferred embodiment of a connection according to the invention between a shaft end of a gas exchange valve of an internal combustion engine and a final control element of a valve actuator.

Of a valve drive mechanism of an internal combustion engine, FIG. 1, for reasons of scale, shows only a gas exchange valve 1, which is actuated by a final control element 2 of a valve actuator 4 in such a way that it executes upward and downward opening and closing motions.

The final control element is embodied as an actuator sleeve 2, which coaxially surrounds a shaft 6 of the gas exchange valve 1 with radial spacing. The shaft 6 of the gas exchange valve 1 extends from a cylinder head, not shown, of the engine through an actuator housing 8 of the valve actuator 4 until essentially a region of an opening 12 embodied in an upper wall 10 of the actuator housing 8 and preferably protrudes some distance out of this opening with its shaft end 14. The free end 16 of the actuator sleeve likewise protrudes from the opening 12 and protrudes some distance past the shaft end 14. Coupled with the actuator sleeve 2 is a hydraulically actuatable differential piston, not shown for reasons of scale, which acts on the actuator sleeve 2 in such a way that the actuator sleeve executes upward and downward motions.

A connection 18 between the shaft end 14 of the gas exchange valve 1 and the free end 16 of the actuator sleeve 2 of the valve actuator 4 includes two shell-like wedge-shaped pieces 22, 24, which cooperate to surround the shaft end 14 of the gas exchange valve 1 and which are axially braced on a step 20 of the actuator sleeve 2, the radially outer circumferential surface of the wedge-shaped pieces extending conically. The wedge-shaped pieces 22, 24 are surrounded by at least one conical clamping sleeve 26, whose radially inner circumferential surface extends complimentary to the cone angle of the wedge-shaped pieces 22, 24; in the radial direction, the conical clamping sleeve 26 is disposed between the wedge-shaped pieces 22, 24 and a radially inner, cylindrical circumferential surface 28 of the free end 16 of the actuator sleeve 2. Furthermore, a clamping body 30 that clamps the conical clamping sleeve 26 to the wedge-shaped pieces 22, 24 is provided, which is braced on the free end 16 of the actuator sleeve 2 and is preferably formed by a threaded piece with a hexagonal socket to facilitate screwing into a female thread 32 of the actuator sleeve 2. Toward the clamping body 30, the outer diameter of the wedge-shaped pieces 22, 24 tapers conically, while the inside diameter of the conical clamping sleeve 26 widens conically in this direction. A clamping shim 34 is disposed axially between the clamping body 30 and an end face, facing toward it, of the conical clamping sleeve 26. A possible loss of axial prestressing force can also be compensated for by designing the actuator sleeve 2 elastically. A radially outer cylindrical circumferential face 36 of the conical clamping sleeve 26 is flush with the radially inner, cylindrical circumferential surface 28 of the free end 16 of the actuator sleeve 2, whose inside diameter is reduced in stages by the step 20 on the side of the wedge-shaped pieces 22, 24 pointing away from the clamping body 30. Thus the conical clamping sleeve 26 and the wedge-shaped pieces 22, 24 are disposed axially between the step 20 of the actuator sleeve 2 and the clamping body 30.

When the clamping body 30 is screwed into the actuator sleeve 2, an axial force is exerted on the conical clamping sleeve 26, which because of the wedging action braces the wedge-shaped pieces 22, 24 axially against the step 20, so that in the axial direction they are connected by positive engagement to the actuator sleeve 2. On the other hand, the axial force exerted on the conical clamping sleeve 26 by the clamping body 30 is so great that both between the radially outer circumferential surface 36 of the conical clamping sleeve 26 and the radially inner circumferential surface 28 of the actuator sleeve 2 and between the wedge faces, toward one another, of the conical clamping sleeve 26 and the wedge-shaped pieces 22, 24 static friction exists, so that the wedge-shaped pieces 22, 24 are additionally coupled to the actuator sleeve 2 by nonpositive engagement.

Figure 2:
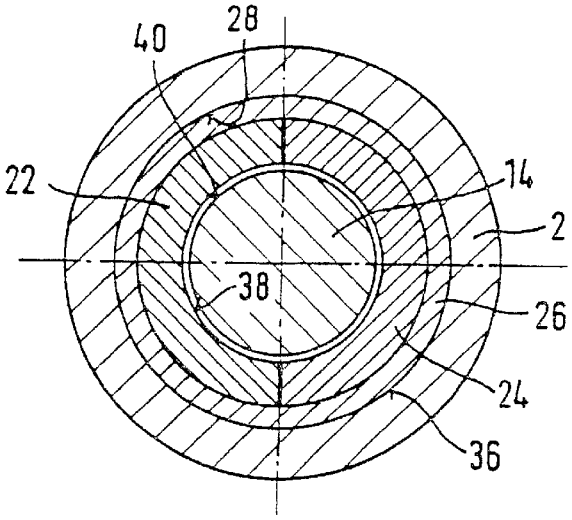
FIG. 2, a cross-sectional view taken along the line II—II of FIG. 1.

Finally, the two wedge-shaped pieces 22, 24 are braced against one another in the radial direction by the action of the conical clamping sleeve 26. However, since as shown in FIG. 2 the wedge-shaped pieces 22, 24 adjoin one another without gaps and are flush in the circumferential direction, making up an encompassing wedge-shaped sleeve whose inside diameter is slightly greater than the outside diameter of the shaft end 14 of the gas exchange valve 1, no frictional-engagement contact that would be sufficient to prevent rotary motions of the shaft end 14 relative to the wedge-shaped sleeve 22, 24, braced by nonpositive engagement in a manner fixed against relative rotation by the actuator sleeve 2, can develop between the circumferential face of the shaft end 14 of the gas exchange valve 1 and a radially inner circumferential surface 38 of the wedge-shaped sleeve 22, 24. The difference in diameter between the inside diameter of the wedge-shaped sleeve 22, 24 and the outside diameter of the shaft end 14 of the gas exchange valve 1 preferably amounts to a few hundredths of a millimeter.

However, in order to transmit the axial motions of the actuator sleeve 2 to the gas exchange valve 1, intermeshing protrusions 42 and recesses 44 are provided on the radially inner circumferential surface 38 of the wedge-shaped pieces 22, 24 and the radially outer circumferential surface 40 of the shaft end 14 of the gas exchange valve 1, creating a positive-engagement connection. To enable rotary motions of the shaft end 14 relative to the wedge-shaped sleeve 22, 24, the protrusions and recesses 42, 44 engage one another with preferably slight axial and radial play.

Figure 3:
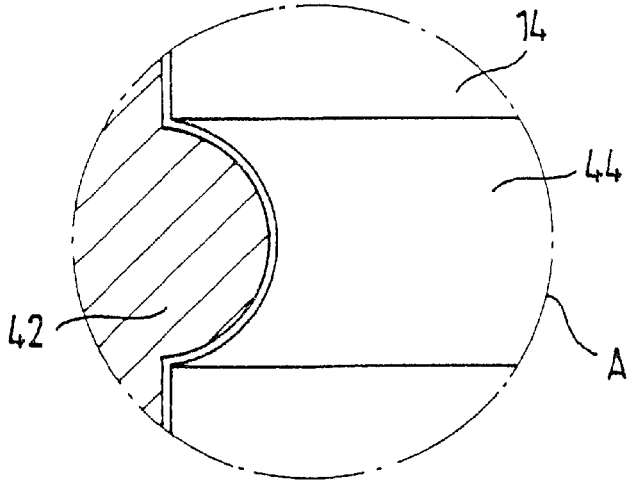
FIG. 3, an enlarged view of the detail A of FIG. 1.

In the preferred embodiment, the wedge-shaped pieces 22, 24, on their radially inner, cylindrical circumferential surface 38, have three circumferentially extending annular beads 42, disposed equidistant axially one after the other, each of which engages a respective associated encompassing annular groove 44 embodied in the shaft end 14. The annular beads 42 and annular grooves 44 preferably have an essentially semicircular cross section, and the inside radius of the annular grooves 44 is greater by preferably a few hundredths of a millimeter than the outside radius of the annular beads 42, as can be seen especially from FIG. 3. As a result there is both radial and axial play, and as a result of this in turn the development of static friction between the shaft end 14 and the wedge-shaped sleeve 22, 24 is prevented. Consequently the gas exchange valve 1 can rotate freely relative to the actuator sleeve 2, while its upward and downward motions are transmitted by means of the positive-engagement connection 18 that has play.

Figure 4:
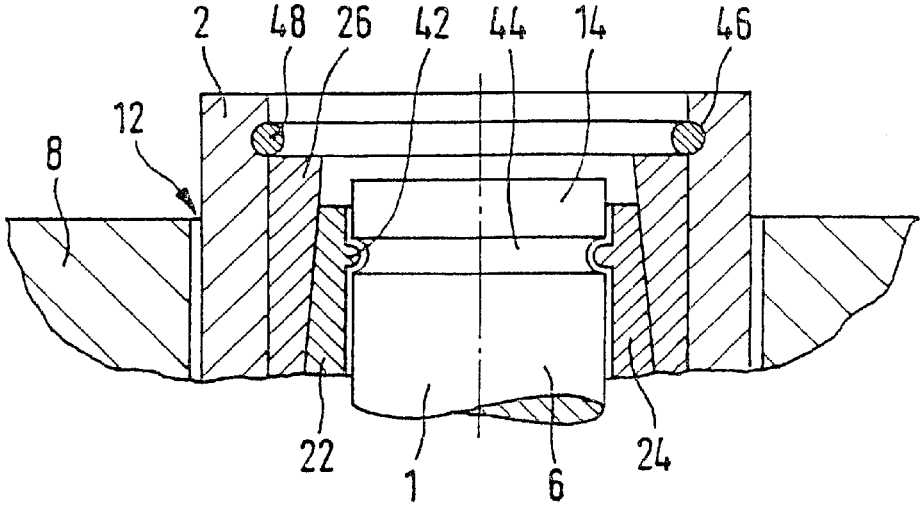
FIG. 4, a further embodiment of the connection of the invention.

In a further embodiment, shown in FIG. 4, the clamping body 30 is not braced via a thread but rather by a securing ring 48, which engages a radially inner annular groove 46 of the actuator sleeve 2 and engages the upper, annular end face of the clamping body 30. In this case, the conical clamping sleeve 26 is press-fitted from above into the actuator sleeve 2 with the aid of a mounting tool and is fixed by the securing ring 48. In that case, the clamping shim 34 can be omitted.

The axial motions of the actuator sleeve 2 are transmitted to the shaft 6 of the gas exchange valve 1 by the wedge-shaped pieces 22, 24, which are spaced apart axially from the thread 32 or from the securing ring 48. The thread 32 or securing ring 48 is then located in a region outside the flow of force extending from the shaft end 14 of the gas exchange valve 1 into the actuator sleeve 2 via the wedge-shaped pieces 22, 24. The notches formed by the thread 32 or the annular groove 46 accordingly do not lessen the durability of the connection 18, which in gas exchange valves 1 is characterized by a high number of load changes.

Since the connection 18 between the shaft end 14 of the gas exchange valve 1 and the actuator sleeve 2 is located in the region of the opening 12 in the upper wall 10 of the actuator housing 8 mounted on the cylinder head, it is easily accessible from above after the valve actuator 4 has been mounted on the cylinder head.

The foregoing relates to preferred exemplary embodiments of the invention, it being understood that other variants and embodiments are possible within the spirit and scope of the invention, the latter being defined by the appended claims.

We claim:

1. A connection (18) between a shaft end (14) of a gas exchange valve (1) of an internal combustion engine and a final control element (2) of a valve actuator (4), comprising at least two shell-shaped wedge-shaped pieces (22, 24), surrounding the shaft end (14) and braced on the final control element (2), the radially outer circumferential surface of the shell shaped pieces extend conically, at least one conical clamping sleeve (26) surrounding said shell shaped pieces and having a radially inner circumferential surface extending complimentary to the cone angle of the wedge-shaped pieces (22, 24), protrusions (42) and recesses (44) that mesh with one another provided on the radially inner circumferential surface (38) of the wedge-shaped pieces (22, 24) and on the radially outer circumferential surface (40) of the shaft end (14) of the gas exchange valve (1), the wedge shaped pieces adjoining one another without gaps in the circumferential direction, forming an encompassing wedge-shaped sleeve (22, 24), whose inside diameter is slightly larger than the outside diameter of the shaft end (14) of the gas exchange valve (1) to enable rotary motions of the shaft end (14) relative to the wedge-shaped pieces (22, 24), the protrusions (42) and recesses (44) meshing with one another with slight play, and wherein a shaft (6) of the gas exchange valve (1) extends from a cylinder head of the engine through an actuator housing (8) of the valve actuator (4) until essentially inside a region of an opening (12), embodied in an upper wall (10) of the actuator housing (8), through which opening the connection (18) is accessible from above after mounting of the valve actuator (4) on the cylinder head.

2. The connection of claim 1, wherein the difference in diameter between the inside diameter of the wedge-shaped sleeve (22, 24) and the outside diameter of the shaft end (14) of the gas exchange valve (1) preferably amounts to a few hundredths of a millimeter.

3. The connection of claim 2 wherein the wedge-shaped pieces (22, 24) have at least one annular bead (42), extending in the circumferential direction and formed on their radially inner, cylindrical circumferential surface (38), of which annular beads each one engages an associated annular groove (44) embodied in the shaft end (14), so as to transmit the tensile and compressive forces, exerted by the final control element (2) on the gas exchange valve (1), essentially by positive engagement.

4. The connection of claim 3 wherein the annular beads (42) and annular grooves (44) have an essentially semicircular cross section, and the inside radius of the annular grooves (44) is slightly greater than the outside radius of the annular beads (42).

5. The connection of claim 2 wherein a shaft (6) of the gas exchange valve (1) extends from a cylinder head of the engine through an actuator housing (8) of the valve actuator (4) until essentially inside a region of an opening (12), embodied in an upper wall (10) of the actuator housing (8), through which opening the connection (18) is accessible from above after mounting of the valve actuator (4) on the cylinder head.

6. The connection of claim 3 wherein a shaft (6) of the gas exchange valve (1) extends from a cylinder head of the engine through an actuator housing (8) of the valve actuator (4) until essentially inside a region of an opening (12), embodied in an upper wall (10) of the actuator housing (8), through which opening the connection (18) is accessible from above after mounting of the valve actuator (4) on the cylinder head.

7. The connection of claim 4 wherein a shaft (6) of the gas exchange valve (1) extends from a cylinder head of the engine through an actuator housing (8) of the valve actuator (4) until essentially inside a region of an opening (12), embodied in an upper wall (10) of the actuator housing (8), through which opening the connection (18) is accessible from above after mounting of the valve actuator (4) on the cylinder head.

8. The connection of claim 1 wherein the final control element of the valve actuator (4) is formed by an actuator sleeve (2), which with radial spacing surrounds the shaft end (14) of the gas exchange valve (1) and whose free end (16) protrudes some distance out of the opening (12) in the wall (10) of the actuator housing (8).

9. The connection of claim 5 wherein the final control element of the valve actuator (4) is formed by an actuator sleeve (2), which with radial spacing surrounds the shaft end (14) of the gas exchange valve (1) and whose free end (16) protrudes some distance out of the opening (12) in the wall (10) of the actuator housing (8).

10. The connection of claim 6 wherein the final control element of the valve actuator (4) is formed by an actuator sleeve (2), which with radial spacing surrounds the shaft end (14) of the gas exchange valve (1) and whose free end (16) protrudes some distance out of the opening (12) in the wall (10) of the actuator housing (8).

11. The connection of claim 7 wherein the final control element of the valve actuator (4) is formed by an actuator sleeve (2), which with radial spacing surrounds the shaft end (14) of the gas exchange valve (1) and whose free end (16) protrudes some distance out of the opening (12) in the wall (10) of the actuator housing (8).

12. The connection of claim 8 wherein a radially outer circumferential surface (36) of the conical clamping sleeve (26) is flush with a radially inner, cylindrical circumferential surface (28) of the actuator sleeve (2), whose inside diameter in the region of the free end (16) of the actuator sleeve (2) is reduced in stages toward the cylinder head by means of a step (20).

13. The connection of claim 9 wherein a radially outer circumferential surface (36) of the conical clamping sleeve (26) is flush with a radially inner, cylindrical circumferential surface (28) of the actuator sleeve (2), whose inside diameter in the region of the free end (16) of the actuator sleeve (2) is reduced in stages toward the cylinder head by means of a step (20).

14. The connection of claim 10 wherein a radially outer circumferential surface (36) of the conical clamping sleeve (26) is flush with a radially inner, cylindrical circumferential surface (28) of the actuator sleeve (2), whose inside diameter in the region of the free end (16) of the actuator sleeve (2) is reduced in stages toward the cylinder head by means of a step (20).

15. The connection of claim 11 wherein a radially outer circumferential surface (36) of the conical clamping sleeve (26) is flush with a radially inner, cylindrical circumferential surface (28) of the actuator sleeve (2), whose inside diameter in the region of the free end (16) of the actuator sleeve (2) is reduced in stages toward the cylinder head by means of a step (20).

16. The connection of claim 12 wherein, viewed in the radial direction, the conical clamping sleeve (26) is disposed between the wedge-shaped pieces (22, 24) and the radially inner circumferential surface (28) of the actuator sleeve (2), and toward the free end (16) of the actuator sleeve (2), the outer diameter of the wedge-shaped pieces (22, 24) is conically tapered and the inner diameter of the conical clamping sleeve (26) is conically widened.

17. The connection of claim 16 wherein a clamping body (30) that clamps the conical clamping sleeve (26) to the wedge-shaped pieces (22, 24) is provided, which is braced on the free end (16) of the actuator sleeve by means of a thread (32) or by means of a securing ring (48) that engages a radially inner annular groove (46) of the actuator sleeve (2), as a result of which the wedge-shaped pieces (22, 24) are axially braced against the step (20).

18. The connection of claim 16 wherein the thread (32) or the securing ring (48) is disposed in a region of the actuator sleeve (2) which is spaced apart preferably axially from the wedge-shaped pieces (22, 24) and conical clamping sleeves (26) that are wedged into one another.

19. The connection of claim 17 wherein the thread (32) or the securing ring (48) is disposed in a region of the actuator sleeve (2) which is spaced apart preferably axially from the wedge-shaped pieces (22, 24) and conical clamping sleeves (26) that are wedged into one another.

20. The connection of claim 18 wherein a clamping shim (34) is disposed between the clamping body (30) and an end face, toward the clamping body, of the conical clamping sleeve (26).

* * * * *